United States Patent [19]

Kutzner et al.

[11] 4,223,823

[45] Sep. 23, 1980

[54] ROTARY WIRE STAPLING APPARATUS

[75] Inventors: Willi A. P. Kutzner; Georg Schneider, both of Wurzburg, Fed. Rep. of Germany

[73] Assignee: Koenig & Bauer Aktiengesellschaft, Wurzburg, Fed. Rep. of Germany

[21] Appl. No.: 65,034

[22] Filed: Aug. 9, 1979

[30] Foreign Application Priority Data

Aug. 12, 1978 [DE] Fed. Rep. of Germany ..... 2835510

[51] Int. Cl.[3] ..... B42B 4/02

[52] U.S. Cl. ..... 227/81

[58] Field of Search ..... 227/81, 85, 87, 88, 227/89, 92

[56] References Cited

U.S. PATENT DOCUMENTS

| | | | |
|---|---|---|---|
| 2,207,413 | 7/1940 | Quick et al. | 227/87 |
| 2,211,027 | 8/1940 | Quick et al. | 227/81 |
| 2,224,743 | 12/1940 | Nolan | 227/87 |
| 2,709,808 | 6/1955 | Murrell et al. | 227/81 |
| 2,722,000 | 11/1955 | Turrall | 227/81 |
| 2,818,568 | 1/1958 | Turrall et al. | 227/81 |

*Primary Examiner*—John McQuade

*Attorney, Agent, or Firm*—Jones, Tullar & Cooper

[57] ABSTRACT

A wire stapling apparatus for use in forming and inserting wire staples in separate signatures, each signature comprising a plurality of sheet layers and with the staples being inserted in the signatures in the direction of motion of the signatures, is disclosed. The apparatus includes a rotating staple closing cylinder and a rotating wire stapling cylinder which cooperates with the staple closing cylinder.

3 Claims, 3 Drawing Figures

ROTARY WIRE STAPLING APPARATUS

FIELD OF THE INVENTION

The present invention is directed to a wire stapling apparatus comprising a rotating staple closing cylinder and a rotating wire stapling cylinder which cooperates with the staple closing cylinder, and having external stapling wire infeed, for individually stapling signatures which comprise a plurality of sheet layers. The staples are inserted in the signatures in the direction of motion of the signatures.

DESCRIPTION OF THE PRIOR ART

Longitudinal wire stapling devices are generally known in the art. These apparatuses are frequently utilized to staple signatures which are to be folded. In these known devices, the signatures have either been held stationary during the stapling operation, or a stapling head portion of the device has moved along with the moving signature to be stapled for a certain period of time. These known devices have been able to perform stapling operations only at relatively low stapling speeds.

SUMMARY OF THE INVENTION

It is an object of the present invention to provide a wire stapling apparatus capable of stapling individual signatures which are comprised of a plurality of sheets. The stapling apparatus utilizes a rotating staple closing cylinder and a cooperating rotating wire stapling cylinder.

Another object of the present invention is to provide a wire stapling apparatus capable of providing every signature with a plurality of staples, in such a manner that the cross pieces of the inserted staples are positioned in the direction of motion of the signatures to be stapled, and are not positioned side by side, but are positioned one behind the other in the direction of motion of the signatures.

As will be discussed in greater detail in the description of a preferred embodiment as set forth hereinafter, the wire stapling apparatus in accordance with the present invention is comprised generally of a rotating stapling closing cylinder and a rotating wire stapling cylinder which cooperates with the staple closing cylinder.

The wire stapling apparatus in accordance with the present invention has the particular advantages of providing a device that facilitates stapling of signatures by means of staples inserted in the direction of motion of the signatures and positioned one behind the other without the necessity of holding the signatures stationary during the stapling operation, and that is capable of operating at high production speeds. The stream of the signatures to be stapled may be fed, for example, directly, that is without the necessity of storing the signatures to be stapled intermediately, into a folding mechanism which is driven at a speed synchronous to that of the printing press. When using the wire stapling apparatus in accordance with the present invention, it is no longer required to staple the signatures in a so-called saddle stitcher in a separate operation.

BRIEF DESCRIPTION OF THE DRAWINGS

While the novel features of the wire stapling apparatus in accordance with the present invention as set forth with particularity in the appended claims, a full and complete understanding of the invention may be had by referring to the detailed description of a preferred embodiment as set forth hereinafter and as may be seen in the accompanying drawings in which:

DESCRIPTION OF A PREFERRED EMBODIMENT

Figure 1:
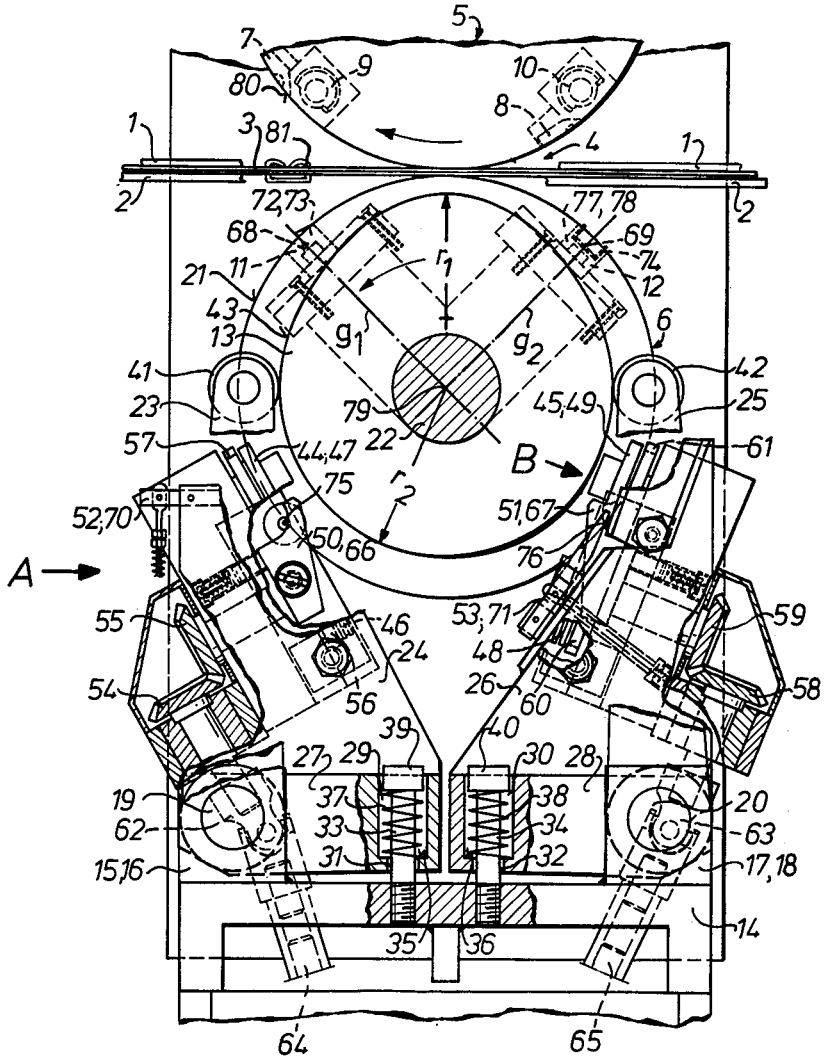
FIG. 1 is a schematic side elevation view of a preferred embodiment of a wire stapling apparatus in accordance with the present invention.

Turning initially to FIG. 1, a folding mechanism (not shown in the drawing) of a web-fed rotary printing machine produces signatures 3 which are conveyed by means of an upper conveyor belt guide 1 and a lower conveyor belt guide 2, which cooperates with the upper conveyor belt guide 1, into an operating slot provided between a rotating staple closing cylinder 5 and a cooperating wire stapling cylinder 6, with the wire stapling cylinder 6 simultaneously producing staples 74 and 81. Feed of stapling wires 75 and 76 is done from outside the wire stapling cylinder 6. The signatures 3 to be stapled comprise, in this preferred embodiment, a plurality of individual sheets which have been collected one upon the other. The signatures 3 may, for example, be open on all their four sides, or may have one fold.

The staple closing cylinder 5 is equipped with a plurality of rigid staple shank bending devices 7 and 8, which are spaced on a common circular line on a peripheral surface 80 of the staple closing cylinder 5, and with cooperating rotatable staple shank bending devices 9, 10 which are capable of rotating around their axis of rotation. The operation of the staple closing cylinder 5 is shown and described in German patent application P 27 55 210.9 and in corresponding United States patent application Ser. No. 966,449 filed Dec. 4, 1978. These applications are incorporated herein by reference.

The staple closing cylinder 5 and the wire stapling cylinder 6 rotate at equal peripheral speeds. The wire stapling cylinder 6 carries an equal number of staple conveyor and staple driving mechanisms 11, 12 as corresponds to the number of rotating staple shank bending devices 9, 10. These staple conveyor and staple driving mechanisms 11, 12 are capable of rotating 90° around straight radial lines $g_1$ and $g_2$, respectively, which lead through the center 79 of the wire stapling cylinder 6. In the preferred embodiment in accordance with the invention, the staple conveyor and staple driving mechanisms 11 and 12 are positioned, as was said above, on a common circular line, and are thus spaced one behind the other. The operating manner and the disposition of the staple conveyor and staple driving mechanisms 11 and 12 are shown and described in German patent application P 27 55 209.6 and in corresponding United States patent application Ser. No. 966,448 filed Dec. 4, 1978. These applications are incorporated herein by reference.

Figure 2:
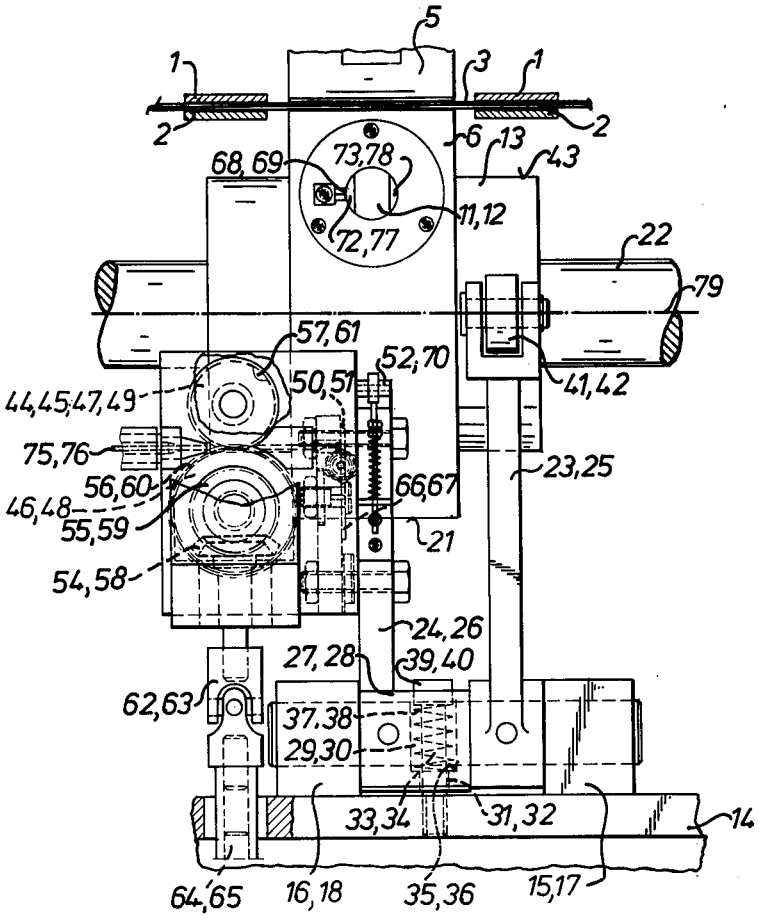
FIG. 2 is a schematic side view taken in the direction of arrow A of FIG. 1.
Figure 3:
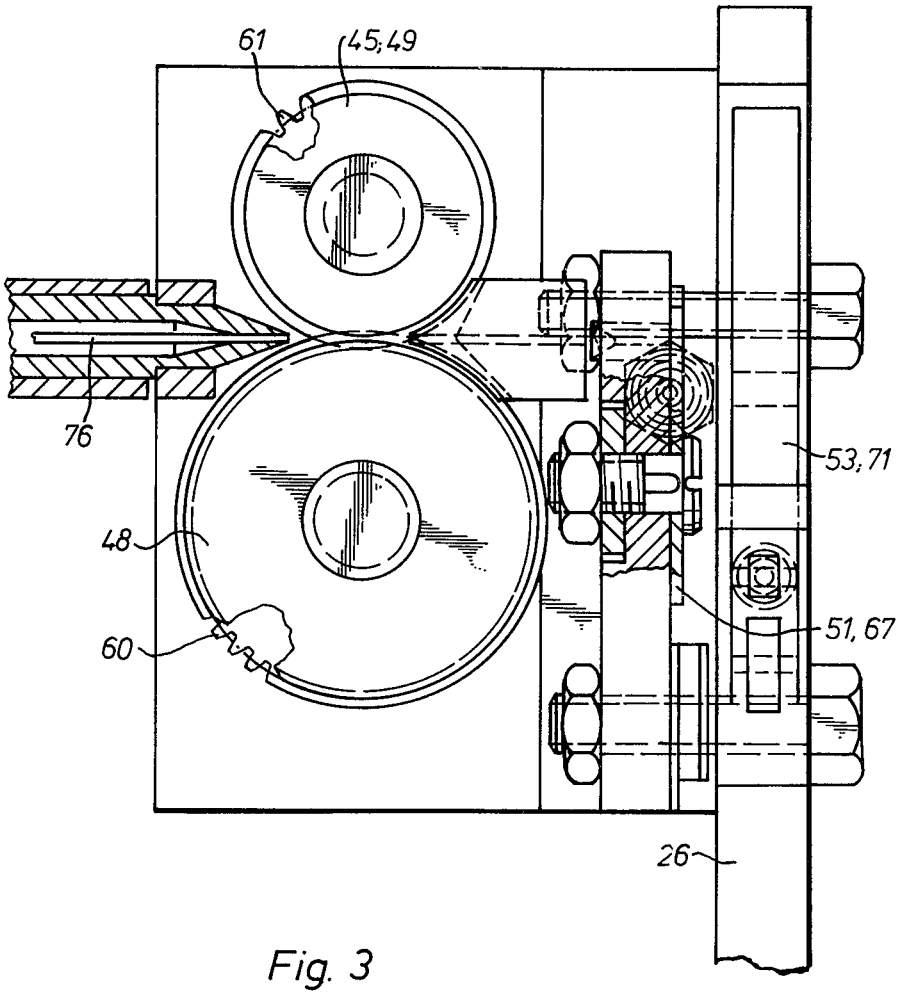
FIG. 3 is a schematic side view taken in the direction of arrow B of FIG. 1.

The wire stapling cylinder 6, which is supported similarly to the staple closing cylinder 5 in side frames (not shown in the drawing), carries a closed control cam 13 on its front end. The periphery of the control cam 13 extends partly on a greater radius "$r_2$" and partly on a smaller radius "$r_1$". Bearing brackets 15, 16 and 17, 18 are welded in pairs on a base plate 14 secured on the machine frame, as seen in FIGS. 1 and 2. An axle 19 is supported in the bearing blocks 15 and 16, and is capable of rotating, as is an axle 20, which is supported in the bearing brackets 17 and 18. The axles 19 and 20 are disposed parallel to the drive shaft 22 of the wire stapling cylinder 6. A switching arm 23 and a seesaw 24 are fixed on the axle 19 by means of pins, the seesaw 24 being disposed beside the switching arm 23. A switching arm 25 and a seesaw 26 are rigidly secured to the axle 20 disposed opposite to the axle 19. The seesaws 24 and 26 both terminate in lower ends having projecting portion 27 or 28, respectively. On the end of each of the projecting portions 27, 28, a cylinder recess 29 and 30 has been bored, these cylinder recesses 29 or 30 ending in through-holes 31 or 32, respectively. A flange bolt 33, 34 is screwed into the base plate 14, each flange bolt 33, 34 leading through a cylinder recess 29 or 30 and through a through-hole 31 or 32, respectively. A compression spring 37 or 38 is tightened between a head portion 39 or 40 of the flange bolts 33 or 34, respectively and the cylinder recess base 35 or 36 of the cylinder recess 29 or 30, respectively.

Each of the switching arms 23, 25 carries a control roller 41 or 42, respectively on its upper end. These control rollers 41, 42 are pressed against a sliding surface 43 of the control cam 13 by means of the flange bolts 33 or 34, compression springs 37 or 38, projecting portions 27 or 28 of the seesaws 24 or 26, and axles 19 or 20, respectively.

Each seesaw 24 or 26 carries a wire feed mechanism 44 or 45, a wire cutting mechanism 50 or 51, and a staple forming mechanism 52 or 53 respectively. In this preferred embodiment of the present invention, the wire feed mechanism comprises wire conveyor rollers 46, 47 or 48, 49, respectively. The wire conveyor rollers 46, 47, 48, 49 are driven by means of a gear train comprising gears 54, 55, 56, 57, or 58, 59, 60, 61, respectively, as may be seen in FIGS. 1 and 2. The input to the gear trains is done by means of a cardan joint 62 or 63 and a cardan shaft 64 or 65, respectively. The cardan shafts 64 or 65 are connected by means of cardan joints (not shown in the drawing) to a drive which runs synchronously with the machine.

The wire cutting mechanism 50 or 51 is comprised of one cutting blade 66 or 67, as is known in the prior art, which is operated by means of a switching cam 68 or 69, respectively fixed on the periphery of the wire stapling cylinder 6.

The staple forming mechanism 52 or 53 comprises, as is also known in the prior art, a staple forming piece 70 or 71 fixed on the seesaw 24 or 26. The staple forming piece 70 or 71 co-acts with cross pieces 72, 73 or 77, 78 of the staple conveyor and staple driving mechanism 11 or 12, respectively.

Each seesaw 24 or 26, is coordinated to one staple conveyor and staple driving mechanism 11 or 12. That is to say, the control cam 13 for the seesaw 24 is constructed in such a manner that it does not lift the seesaw 24 when the staple conveyor and driving mechanism 11 passes the resting position of the seesaw 24, so that a staple can be formed. During this operation, the cross pieces, for example, cross pieces 72 and 73 of the staple conveyor and staple driving mechanism 11 are positioned side by side as seen in the direction of rotation of the wire stapling cylinder 6. In this position staples 81 are formed and conveyed between, for example, the cross pieces 72 and 73. Since supply of the stapling wire 75 or 76 is done continuously in the wire feed mechanism 44 or 45, the stapling wire 76, for example, is pushed at least partly over the staple forming mechanism 53. That means, that the already advanced stapling wire 76 would withdraw the staple 81 out of the staple conveyor and staple driving mechanism 11, if the seesaw 26 with the mechanisms for wire conveying, wire forming and wire cutting installed on it is not lifted off the periphery 21 of the wire stapling cylinder 6. Furthermore, the switching cam 68 coordinated to the staple conveyor and staple driving mechanism 11 for the cutting blade 66 would also operate the cutting blade 67, so that the stapling wire 76 in the wire feed mechanism 45 would be cut. If, however, the seesaw 26 is temporarily lifted off the periphery 21 of the wire stapling cylinder 6, the staple conveyor and staple driving mechanism 11 with the staple 81 is capable of passing by the zone in which the mechanisms are installed on the seesaw 26. Approximately at the level of the control roller 42, the staple conveyor and staple driving mechanism 11 is turned for 90° - together with the staple 81 which is received by the staple conveyor and staple driving mechanism 11. In this position the staple 81 is driven through the signature 3 and is closed by means of the coordinated staple shank bending devices 7 and 9.

When the staple conveyor and staple driving mechanism 12 passes by the seesaw 24 and the mechanisms installed thereon for wire conveying, wire cutting and wire forming, the seesaw 24 is lifted off the periphery 21 of the wire stapling cylinder 6. Thus the switching cam 69 is prevented from operating the cutting blade 66 to cut off the portion of the stapling wire which is already over the staple forming mechanism 52. As soon as the staple conveyor and staple driving mechanism 12 has passed by the seesaw 24, the wire end portion, cut off the stapling wire 76, is carried and conveyed by the cross pieces 77, 78 of the staple conveyor and staple driving mechanism 12 and the staple 74 is formed by means of the staple forming device 71 in cooperation with the cross pieces 77, 78. During this operation the cross piece of the staple 74 is positioned in the direction of the axis of rotation of the wire stapling cylinder 6. As soon as the staple 74 has left the staple forming mechanism 53, the staple conveyor and staple driving mechanism 12 which carries the staple 74 is turned 90° around its longitudinal axis, that is, the cross piece of the staple 74 now forms, together with the axis of rotation 79 of the wire stapling cylinder 6, an angle of 90°. In this position the staple 74 is driven through the signature 3 and is closed by means of the staple closing mechanism 8, 10.

We claim:

1. A wire stapling apparatus comprising a rotating staple closing cylinder and a cooperating rotating wire stapling cylinder, with external stapling wire infeed, for stapling individual signatures, having a plurality of sheet layers, in the direction of motion of the signatures, characterized in that a plurality of staple conveyor and staple driving mechanisms are spaced around a periphery of the wire stapling cylinder, each said staple conveyor and staple driving mechanism being capable of rotating around a straight radial line extending from the center of the stapling cylinder to its periphery, an equal number of staple closing mechanisms as staple conveyor and staple driving mechanisms being disposed around a periphery of the staple closing cylinder to cooperate with said staple conveyor and staple driving mechanisms, each of the staple conveyor and staple driving mechanisms being provided with its individually coordinated wire feed mechanism, wire cutting mechanism, and staple forming mechanism, each of said wire feed mechanisms, wire cutting mechanisms, and staple forming mechanisms being capable of being rhythmically displaced from the periphery of the wire stapling cylinder when a staple conveyor and staple driving mechanism, which is not coordinated to said wire feed mechanism, wire cutting mechanism, and staple forming mechanism, passes by said wire feed mechanism, wire cutting mechanism, and staple forming mechanism.

2. A wire stapling apparatus in accordance with claim 1, characterized in that a control cam rotating synchronously with the wire stapling cylinder is provided for controlling the instant of displacing the wire feed mechanism, wire cutting mechanism, and staple forming mechanism.

3. A wire stapling apparatus in accordance with claim 2, characterized in that a seesaw is provided for receiving the wire feed mechanism, wire cutting mechanism, and staple forming mechanism, said seesaw being rigidly secured to an axle which is capable of being displaced, the axle being supported in bearing brackets which are secured to the machine frame, a switching arm being rigidly secured to the axle, said switching arm being in operative connection with the control cam through the control roller means.

* * * * *